US010517401B2

(12) United States Patent
Zanayed

(10) Patent No.: US 10,517,401 B2
(45) Date of Patent: Dec. 31, 2019

(54) POSTURE CORRECTING SYSTEM AND RELATED METHODS

(71) Applicant: Anthony Zanayed, Tinley Park, IL (US)

(72) Inventor: Anthony Zanayed, Tinley Park, IL (US)

( * ) Notice: Subject to any disclaimer, the term of this patent is extended or adjusted under 35 U.S.C. 154(b) by 0 days.

(21) Appl. No.: 16/026,407

(22) Filed: Jul. 3, 2018

(65) Prior Publication Data

US 2018/0310712 A1 Nov. 1, 2018

Related U.S. Application Data

(63) Continuation-in-part of application No. 29/599,695, filed on Apr. 5, 2017, now Pat. No. Des. 824,682.

(51) Int. Cl.

| | |
|---|---|
| ***A47C 9/02*** | (2006.01) |
| ***A47C 3/027*** | (2006.01) |
| ***A47C 4/54*** | (2006.01) |
| ***A47C 3/30*** | (2006.01) |
| ***A47C 7/14*** | (2006.01) |
| *A47C 7/54* | (2006.01) |
| *A47C 7/00* | (2006.01) |

(52) U.S. Cl.

CPC ..... *A47C 4/54* (2013.01); *A47C 3/30* (2013.01); *A47C 7/142* (2018.08); *A47C 7/002* (2013.01); *A47C 7/54* (2013.01)

(58) Field of Classification Search

CPC ..... A47C 9/002; A47C 4/54; A47C 3/029; A47C 3/16; A47C 9/025; A47C 7/029; A47C 27/085; A47C 3/30; A63B 41/00; A63B 2208/0233; A63B 2225/62; A63B 23/0211; A63B 26/003; B60N 2/914; B60N 2/502; B60N 2/66; B60N 2/665; B60N 2/505; B60N 2/525

See application file for complete search history.

(56) References Cited

U.S. PATENT DOCUMENTS 3,312,437 A * 4/1967 Valerie Barth ..... A47C 3/029 248/158
3,843,197 A * 10/1974 Wright ..... A47C 3/18 297/423.38
4,623,195 A * 11/1986 Avella ..... A47C 7/004 248/230.2
5,439,269 A * 8/1995 Cheng ..... A47C 4/02 108/150
5,690,389 A * 11/1997 Ekman ..... A47C 3/16 248/599
5,836,555 A * 11/1998 Ellsworth ..... A47C 7/004 248/161

(Continued)

*Primary Examiner* — Shin H Kim
(74) *Attorney, Agent, or Firm* — Alex Shtraym

(57) ABSTRACT

The invention relates generally to a system and methods for facilitating correcting and maintaining a good posture. More specifically, the invention is directed to a posture correcting chair including a seating component, a pump mechanism, and a frame assembly. The seating component may include an inflatable element and a base element. The inflatable element and the base element form a housing. The pump mechanism may include a pump—such as a mechanical or electrical pump—for pumping a medium into or out from the housing such that an occupant of the seating component may maintain a good posture.

17 Claims, 7 Drawing Sheets

(56) References Cited

U.S. PATENT DOCUMENTS 5,988,754 A * 11/1999 Lamart ..... A47C 7/506
248/161
6,003,944 A * 12/1999 Glockl ..... A47C 3/18
297/337
6,616,238 B1 * 9/2003 Guery-Strahm ..... A47C 9/002
297/440.1
6,695,407 B1 * 2/2004 Lin ..... A47C 1/02
248/161
7,530,639 B2 * 5/2009 Groelsma ..... A47C 1/03255
297/344.18
7,686,396 B2 * 3/2010 Schaaf ..... A47C 7/14
297/313
8,056,976 B1 * 11/2011 Polk ..... A47C 3/029
297/258.1
8,926,483 B1 * 1/2015 Holloway ..... A63B 26/003
297/271.5
9,060,612 B2 * 6/2015 Lee ..... A47C 7/14
D749,682 S * 2/2016 Thomason ..... A63B 23/1236
D21/662
D764,200 S * 8/2016 Elmaleh ..... D6/349
9,609,950 B2 * 4/2017 Covelli ..... A47C 7/14
D789,723 S * 6/2017 Walser ..... D6/716.1
D829,456 S * 10/2018 Chiu ..... D6/349
10,219,632 B2 * 3/2019 Mengshoel ..... A47C 3/027
2003/0151291 A1 * 8/2003 Lin ..... A47C 7/004
297/423.38
2007/0138850 A1 * 6/2007 Oettinger ..... A47C 3/029
297/271.5
2008/0191525 A1 * 8/2008 Jensen ..... A47C 9/002
297/217.2
2012/0256453 A1 * 10/2012 Marino ..... A47C 9/10
297/188.08
2014/0265495 A1 * 9/2014 Bay ..... A47C 7/402
297/311
2015/0351549 A1 * 12/2015 Chadwick ..... A47C 3/029
297/311
2016/0113401 A1 * 4/2016 Covelli ..... A47C 7/14
297/452.48
2016/0174716 A1 * 6/2016 Covelli ..... A47C 7/14
297/250.1

* cited by examiner

POSTURE CORRECTING SYSTEM AND RELATED METHODS

CROSS-REFERENCE TO RELATED APPLICATION

This application is a continuation-in-part of U.S. Application No. 29/599,695 filed Apr. 5, 2017, which is incorporated by reference in its entirety.

FIELD OF THE INVENTION

The invention relates generally to a system and methods for facilitating correcting and maintaining a good posture. More specifically, the invention is directed to a posture correcting chair including a housing configured to inflate for correcting an occupant's posture.

The invention is useful in a variety of contexts and environments including commercial and residential.

BACKGROUND OF THE INVENTION

In medicine and occupations concerned with physical fitness, posture is defined as the position in which you hold your body while standing, sitting, or performing certain tasks, such as lifting, bending, pulling, or reaching. Posture affects various aspects of mental and physical health including appearance, strength, and endurance.

Good posture refers to the proper alignment of the body's segments such that the least amount of strain is placed on the bones, joint, and other supporting structures. This ideal position provides for a state of muscular and skeletal balance that properly distributes body weight and the stresses it causes along the length of the spine. Adopting a good posture may improve breathing, reduce pain and stiffness, and help circulate bodily fluids.

Those adopting a poor posture may be susceptible to several health risks including headaches, diminished breathing, and back pain. Poor posture refers to an unnatural spine position that causes certain muscles to tighten up or shorten while other muscles lengthen and become weak. This unnatural position results in extra stress on joints, muscles, and vertebrae and is often difficult to correct.

One source of poor posture stems from remaining fixed in one position for an extended period of time. For example, sitting for prolonged periods is a great hindrance to good posture. In particular, the seated position often places stress on muscles and discs of the back and neck. This position results in tightness of certain muscles that support the spine.

Also, those in a prolonged seated position typically slouch over or down. Slouching can cause the spinal ligaments to stretch beyond their healthy limit and strain the spinal discs. After a time, slouching feels normal and becomes harder to correct because the muscle memory stores the information needed for poor posture, and disposed of the memory for correct posture.

A number of traditional products are available that may mitigate the adverse effects associated with a prolonged sitting position. One example includes posture correctors or posture braces. These products are designed to help improve postures and maintain the body in a straight and upright position. While posture correctors can help support your neck, shoulders, and back, they are not intended for long term use. In particular, these products should not be used over extended periods of time as they tend to weaken certain muscles. In addition, because posture correctors are typically worn under clothing, they may be uncomfortable, visible under certain outfits, and suit certain body shapes better than others.

Other traditional products include ergonomic chairs. Ergonomic chairs often take into account a number of features for correcting and maintaining a good posture, such as the general lumbar curve of the user, release of pressure points around the body of the user, the ability of the chair to accommodate movements of the user, and the ease of the user to adjust the chair to maximize comfort. However, these chairs are typically not being used properly because users are unaware of the adjustment needed to maintain a good posture. For example, these chairs typically include armrests and backrests that facilitate slouching or other positions that conflict with maintaining a good posture. In addition, unlike most chairs designed for comfort or appearance, posture correcting chairs are inherently expensive.

Another traditional product that users may use to mitigate the adverse effects associated with a prolonged sitting position is an exercise ball. Exercise balls typically do not have a backrest, compelling the user to sit upright with feet flat on the floor. Also, because exercise balls are elastic, they may engage certain muscle groups that require balance and fix the user to a proper posture. While inexpensive, exercise balls are typically bulky, fragile, and lack stability. In addition, exercise balls may be unprofessional in certain commercial environments, such as in an office context.

A demand therefore exists for a posture correcting device that is affordable, adjustable, and appropriate for different environments. In particular, there is a need for a posture correcting chair that is appropriate for use in a professional context and includes an inflatable housing in order to provide different configurations for correcting an occupant's posture. The present invention satisfies these demands.

SUMMARY OF THE INVENTION

The invention relates generally to a system and methods for facilitating correcting and maintaining a good posture. More specifically, the invention is directed to a posture correcting chair including an inflatable housing for correcting an occupant's posture.

Certain preferred embodiments of the posture correcting chair include a seating component, a pump mechanism, and a frame assembly. The seating component may include an inflatable element and a base element. In certain embodiments, a housing is formed between the inflatable element and the base element.

In certain preferred embodiments, the pump mechanism may extend from the seating component and facilitate inflating and deflating the housing. More specifically, the pump mechanism may include a pump—such as a mechanical or electrical pump—for pumping a medium into or out from the housing, as described below. In certain embodiments, the pump mechanism is integral with the base element of the seating component. In other embodiments, the pump mechanism may suspend below the base element of the seating component to, for example, facilitate accessing the pump from various positions. For purposes of this application, a medium may include a gas—such as air—or a liquid, such as water.

Certain embodiments of the pump mechanism may pump a medium into or out from the housing through one or more holes of the seating component. In particular, the seating component may include holes interposed between the inflatable element and the base element, through which the pump mechanism may convey the medium. For example, the pump mechanism may include a first pathway to convey a medium from outside the housing through a first hole to inside the housing. In another example, the pump mechanism may include a second pathway to convey the medium from inside the housing through a second hole to outside the housing. Embodiments of the pump mechanism may further be configured to open and close the holes of the seating component. The inflation and deflation of the housing facilitates the different configurations of the seating component.

In certain preferred embodiments, the seating component is adjustable by inflating or deflating the housing. For example, the addition of a medium to the housing may increase the amount of resistance a user feels and, as a result of the increased resistance, require the user to maintain a good posture. Alternatively, a user may deflate the housing by release a medium from the housing and, as a result of the lesser resistance, provide the user with a softer seating component.

Certain embodiments of the seating component may further include a sensor, such as a pressure sensor or proximity sensor. A pressure sensor may detect the pressure within the housing to determine whether a user is sitting on the seating component. Moreover, the pressure sensor may determine whether the amount of medium within the housing is low. A proximity sensor may emits an electromagnetic field and look for changes in the field to determine whether a user is nearby. In certain embodiments, based on the reading of the sensors, a signal may alert the user to change the configuration—such as by adding or releasing medium—of the seating component.

In certain preferred embodiments, the inflatable element of the seating component may include a compressed configuration and a semi-spherical configuration. A semi-spherical configuration is formed by conveying an inflating medium into the housing. It is contemplated that the semi-spherical configuration of the seating component is shaped to correct and/or maintain an occupant's posture.

Users may also adjust the seating component to form a compressed configuration. The compressed configuration may result from the release of the inflating medium from the housing. For example, a user may release the medium through a release tab or extract the inflating medium from the housing, such as through the use of the pump mechanism.

In certain preferred embodiments, the inflatable element of the seating component may include at least three layers: an upholstery layer, a silicone polymer layer, and an elastomer layer. The upholstery layer may cover the seating component and include a fabric, such as cotton, polyester, or a combination of each. The housing may include the silicone polymer layer and elastomer layer. In particular, the silicone polymer layer may act as barrier to protect the elastomer layer in case of cuts or punctures to the inflatable element.

Further embodiments of the posture correcting chair may include a frame assembly connected to the seating component. In particular, a post member of the frame assembly may extend from the base element of the seating component. The frame assembly may further include support elements—such as legs—extending outwardly from the post member. Embodiments of the invention also contemplate a lever which is pivotably mounted to the post member of the frame assembly for controlling the height of the seating component, for example, by actuation of a height adjusting cylinder mounted to the post member.

In certain preferred embodiments, the posture correcting chair may include a pair of handle bars. The handle bars may connect to the base element of the seating component. The handle bars may be hinged to the bottom surface in order to pivot between an upright position above the base element of the seating component and a lowered position below the base element of the seating component. In certain embodiments, the posture correcting chair does not include a back rest or arm rests, compelling the user to sit upright with feet flat on the floor. However, the user may engage the handle bars for balance and support.

While the invention is susceptible to various modifications and alternative forms, specific exemplary embodiments are shown by way of example in the following drawings which are described in detail. It should be understood, however, that there is no intent to limit the invention to the particular embodiments disclosed. On the contrary, the intention is to cover all modifications, equivalents, and alternatives falling within the scope of the invention as defined by the appended claims.

BRIEF DESCRIPTION OF THE DRAWINGS

The present invention can be better understood by reading the following detailed description of certain preferred embodiments, reference being made to the accompanying drawings in which.

DETAILED DESCRIPTION OF THE INVENTION

Figure 1:
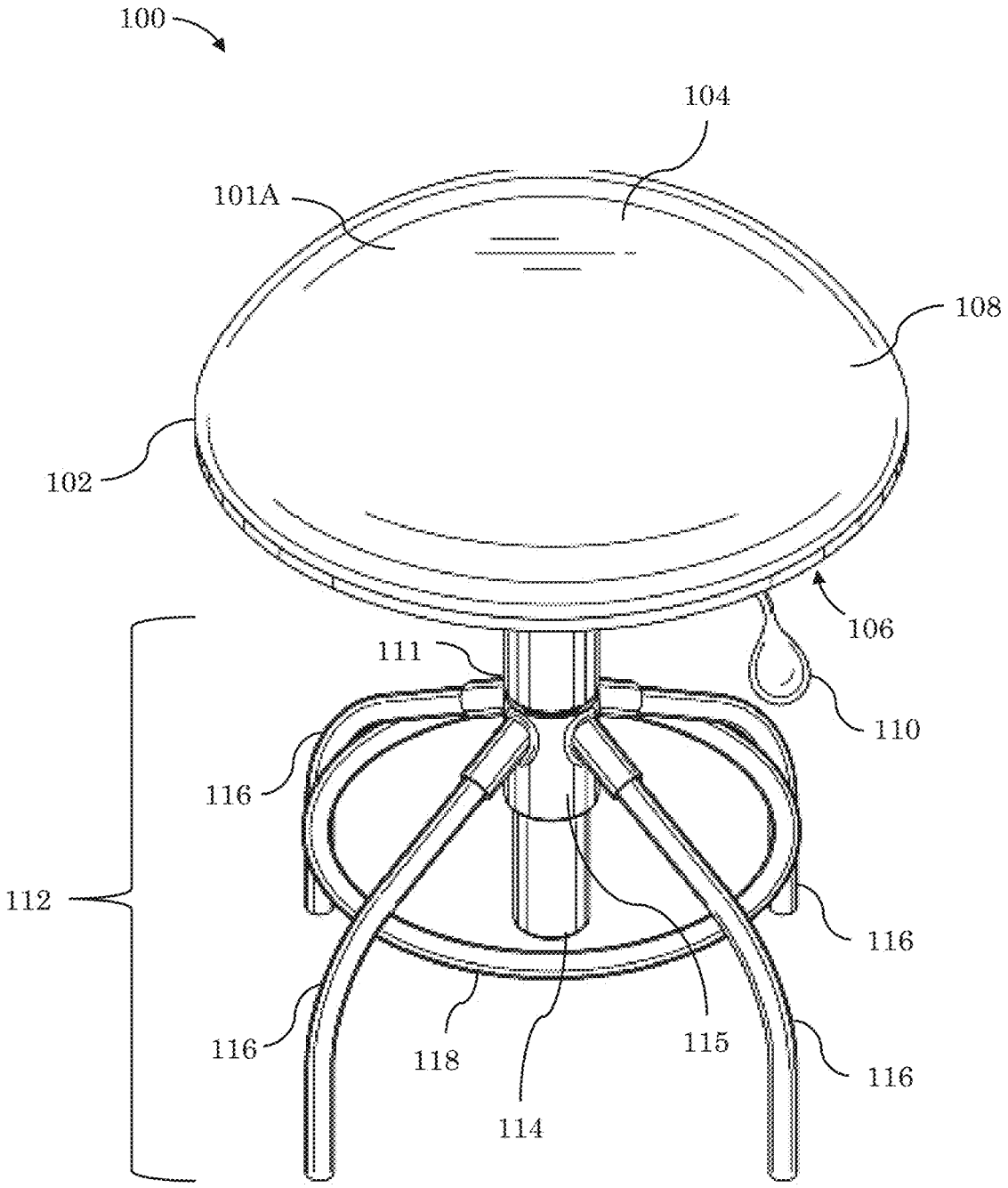
FIG. 1 illustrates a top perspective view of the posture correcting chair according to an embodiment of the invention.
Figure 3:
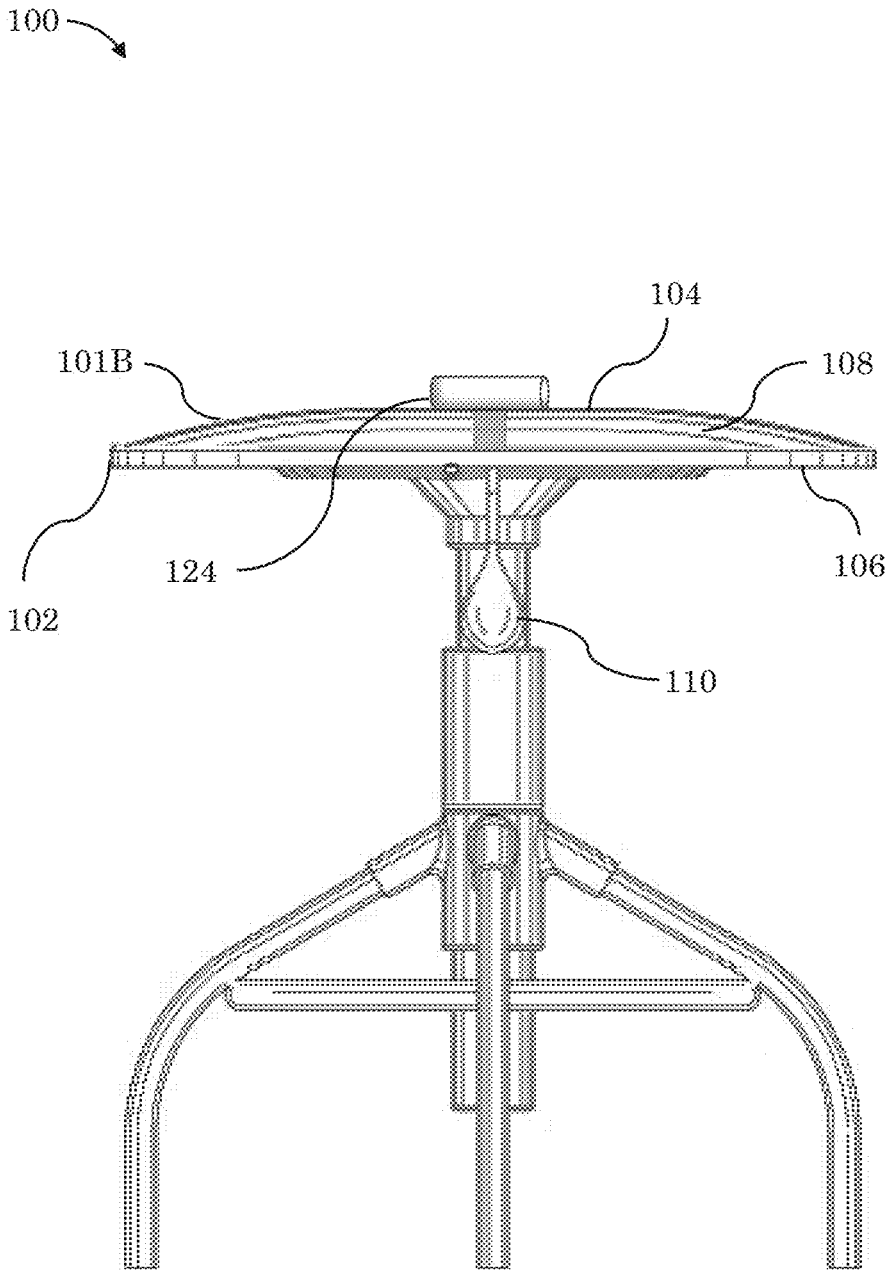
FIG. 3 illustrates an elevation view of a first side of the posture correcting chair having a seating component in a compressed configuration according to an embodiment of the invention.

A posture correcting chair 100 is shown in FIG. 1. The posture correcting chair 100 includes a seating component 102, a pump mechanism 110, and a frame assembly 112. The seating component 102 includes an inflatable element 104 and a base element 106. The inflatable element 104 and the base element 106 form a housing 108. The housing 108 may be inflatable by a gas—such as air—or a liquid. When the housing 108 is inflated, the seating component 102 may have a semi-spherical configuration 101A as shown in FIG. 1. When the housing 108 is deflated, the seating component may have a compressed configuration 101B (FIG. 3).

The posture correcting chair 100 of FIG. 1 further includes a frame assembly 112. The frame assembly includes a post member 114, a height adjusting cylinder 111, and a support cylinder 115. The post member 114 extends from the base element 106 of the seating component 102.

The support cylinder 115 is attached to the post member and may facilitate stabilizing the posture correcting chair 100. In particular, a plurality of support elements 116 extend outwardly from the support cylinder 115 to provide stability for a user. It is also contemplated that support elements 116 may include wheels to facilitate movement of the posture correcting chair 100. The frame assembly 112 further includes a height adjusting cylinder 111 that may releasably fix the position of the post member 114 to raise and lower the height of the seating component 102 depending on the needs of a user.

Figure 2:
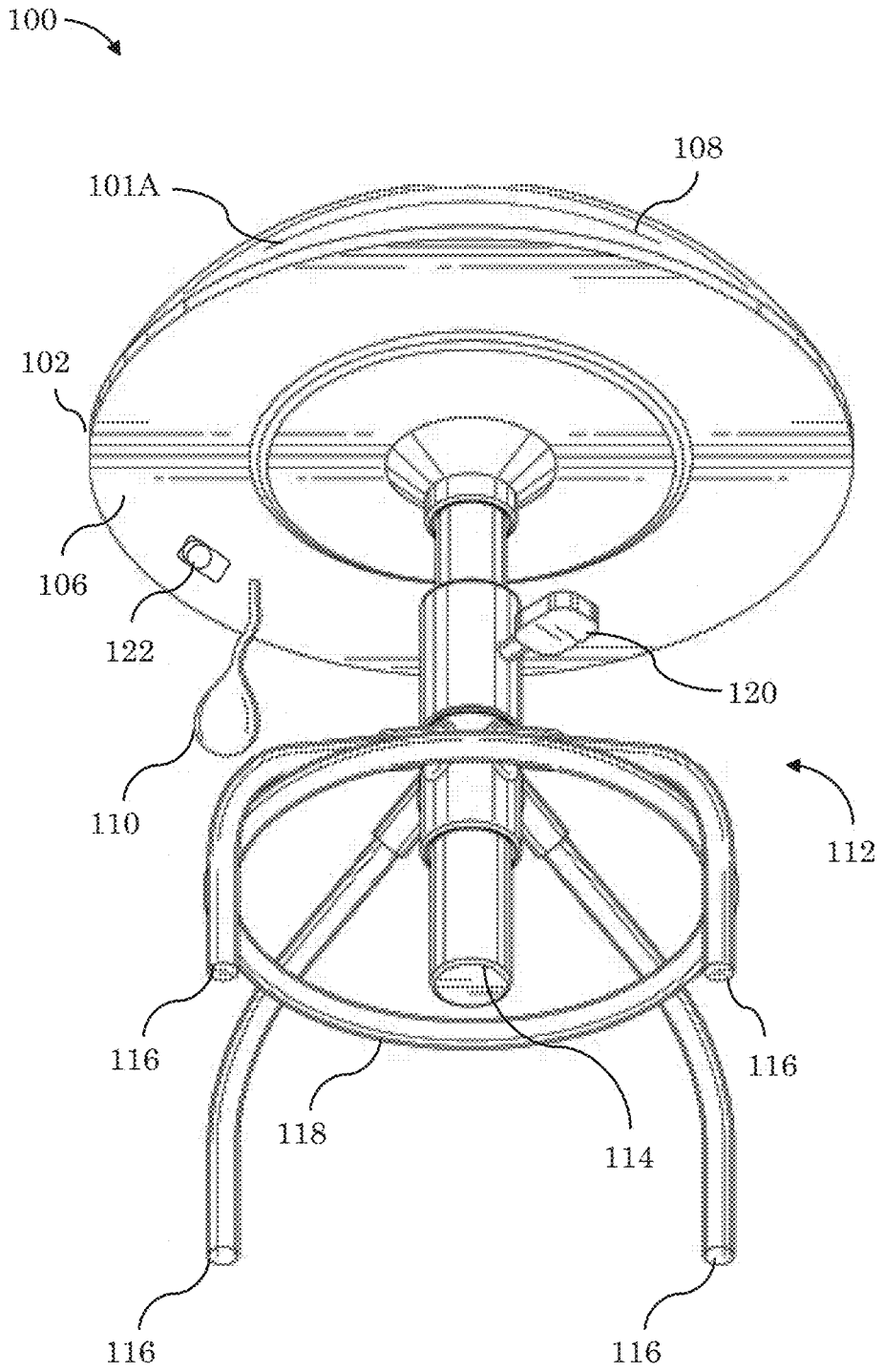
FIG. 2 illustrates a bottom perspective view of the posture correcting chair according to an embodiment of the invention.

The position of the seating component 102 is adjustable by lever 120 as shown in FIG. 2. In particular, lever 120 lever may pivotably mounted to the post member 114 of the frame assembly 112 for controlling the height of the seating component 102, for example, by actuating the height adjusting cylinder 111.

As shown in FIG. 2, the pump mechanism 110 extends out from the base element 106 of the seating component 102. While illustrated as including a mechanical or manually-operated pump, it is contemplated that the pump mechanism 110 may include an electric pump for pumping the housing 108. For example, an electric pump may include batteries or connect to an outlet to, for example, actuate the pumping of a medium into the housing 108. In addition, the position of the pump mechanism 110 is for illustrative purposes only. For example, pump mechanism may be integral with the base element 106 (FIGS. 6-7) or positioned within the post member 114 of the frame assembly 112.

As mentioned, pump mechanism 110 facilitates inflating and deflating the housing 108 of the seating component 102. As shown in FIG. 2, the pump mechanism 110 is a mechanical pump that a user may engage to convey a medium into the housing 108. In operation, a user may continuously compress the pump mechanism 110 to inflate the housing such that the semi-spherical configuration 101A is formed. To deflate, a user may compress the pump mechanism 110 such that the medium is allowed to flow out of the housing 108.

In certain embodiments, a pump mechanism may include one or more pathways to convey a medium into or out from the housing 108 through one or more holes of the seating component 102. For example, the pump mechanism may include a first pathway to convey a medium from outside the housing 108 through a first hole to inside the housing 108. In another example, the pump mechanism may include a second pathway to convey the medium from inside the housing 108 through a second hole to outside the housing 108.

As shown in FIG. 2, base element 106 may further include a release tab 122. In a deflating operation, release tab 122 may open to release a medium from the housing 108. For example, a user may simply place the release tab 122 in an open position and allow the inflating medium to naturally flow out from the housing 108. Alternatively, the user may apply pressure—such as sitting on the seating component 102—such that the medium is forced out from the housing 108 through the release tab 122.

Figure 4:
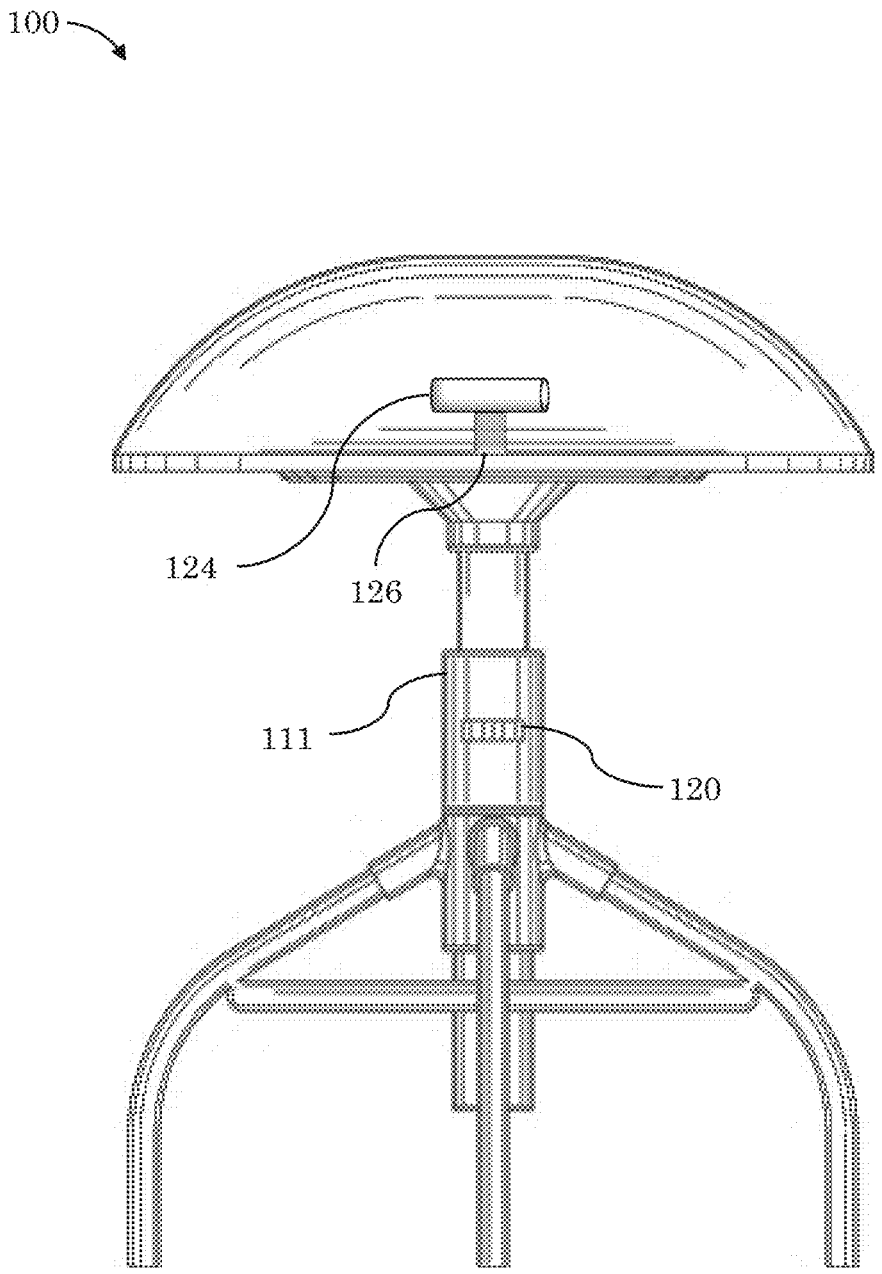
FIG. 4 illustrates an elevation view of a second side of the posture correcting chair having a seating component in a semi-spherical configuration according to an embodiment of the invention.

As the medium exits the housing 108, the seating component 102 may form the compressed configuration 101B shown in FIG. 3. The compressed configuration 101B of the seating component 102 may still provide a user with enough support and comfort. As shown in FIGS. 3 and 4, the seating component 102 may further include handles 124 that permit a user to balance. Handles 124 are not like arm rests that are associated with traditional chairs. In particular, handles 124 are configured for a user's hands rather than his or her arms. For example, a user cannot slouch to one side or the other by leaning on the handles 124. In addition, embodiments of the posture correcting chair 100 do not include a back rest as seen with many traditional chairs. Back rests are typically associated with slouching forward or backward and, as a result, creating a poor posture. The posture correcting chair 100 may compel users to sit upright with feet flat on the floor. Also, depending on the configuration of the seating component 102, the posture correcting chair 100 may engage certain muscle groups that require balance and fix the user to a proper posture.

Figure 5:
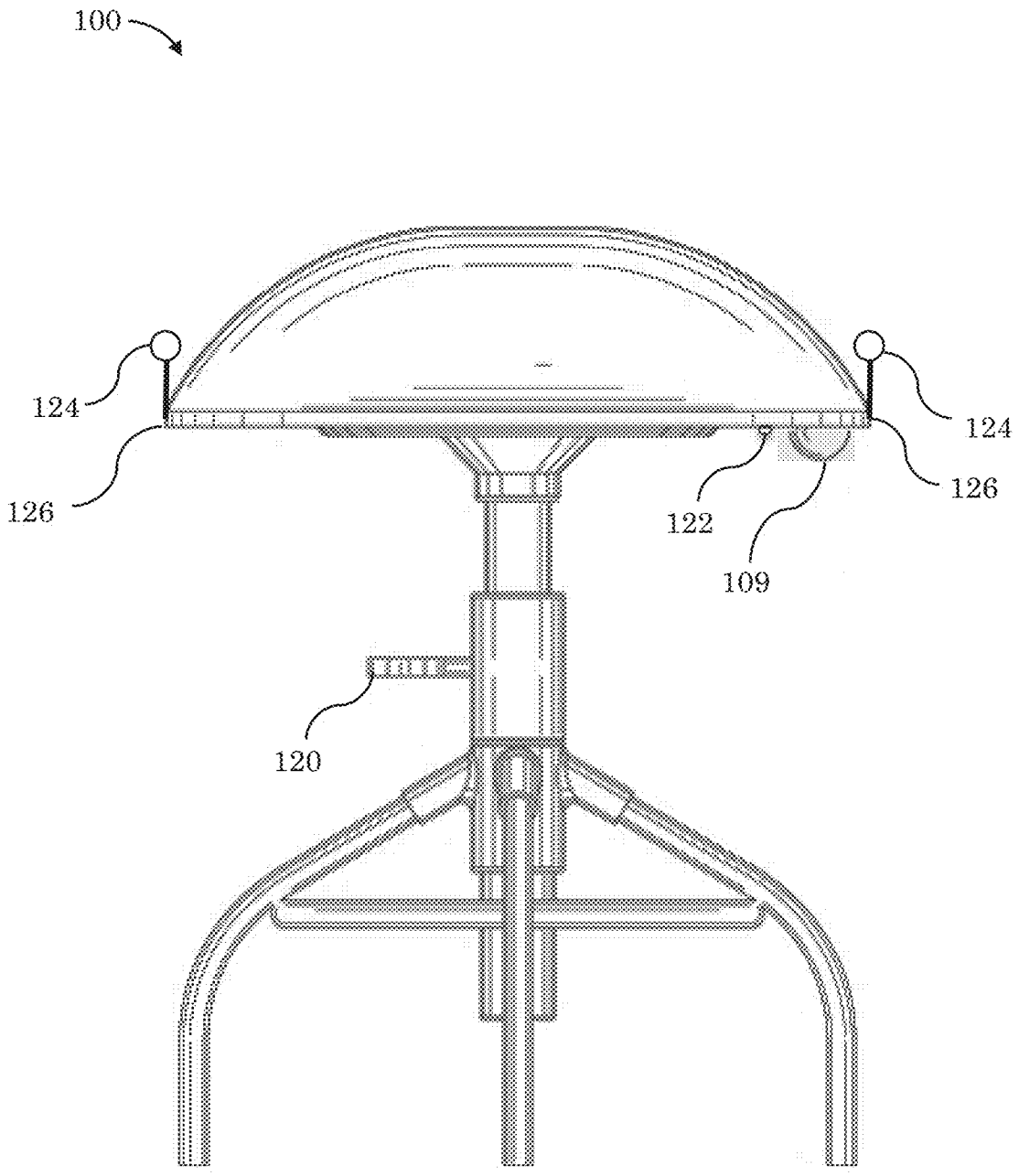
FIG. 5 illustrates an elevation view of a third side of the posture correcting chair according to an embodiment of the invention.

FIG. 5 illustrates a side elevation view of the posture correcting chair 100, in accordance with an embodiment of the invention. As seen in FIG. 5, pump mechanism 109 is integral with the base element 106 of the seating component 102. Users may prefer the positioning of pump mechanism 109 as compared to pump mechanism 110 of FIG. 2 for various reasons. For example, pump mechanism 109 is less likely to be damaged as it does not suspend below the base element 106.

The posture correcting chair 100 of FIG. 5 further includes handles 124 connected to the seating component 102 by a hinge 126. Hinge 126 may facilitate different positioning of the handles, based on the user's preferences or comfort. For example, FIG. 5 illustrates handles 124 in an upright position above the seating component 102 such that a user may balance or feel more secure.

Figure 6:
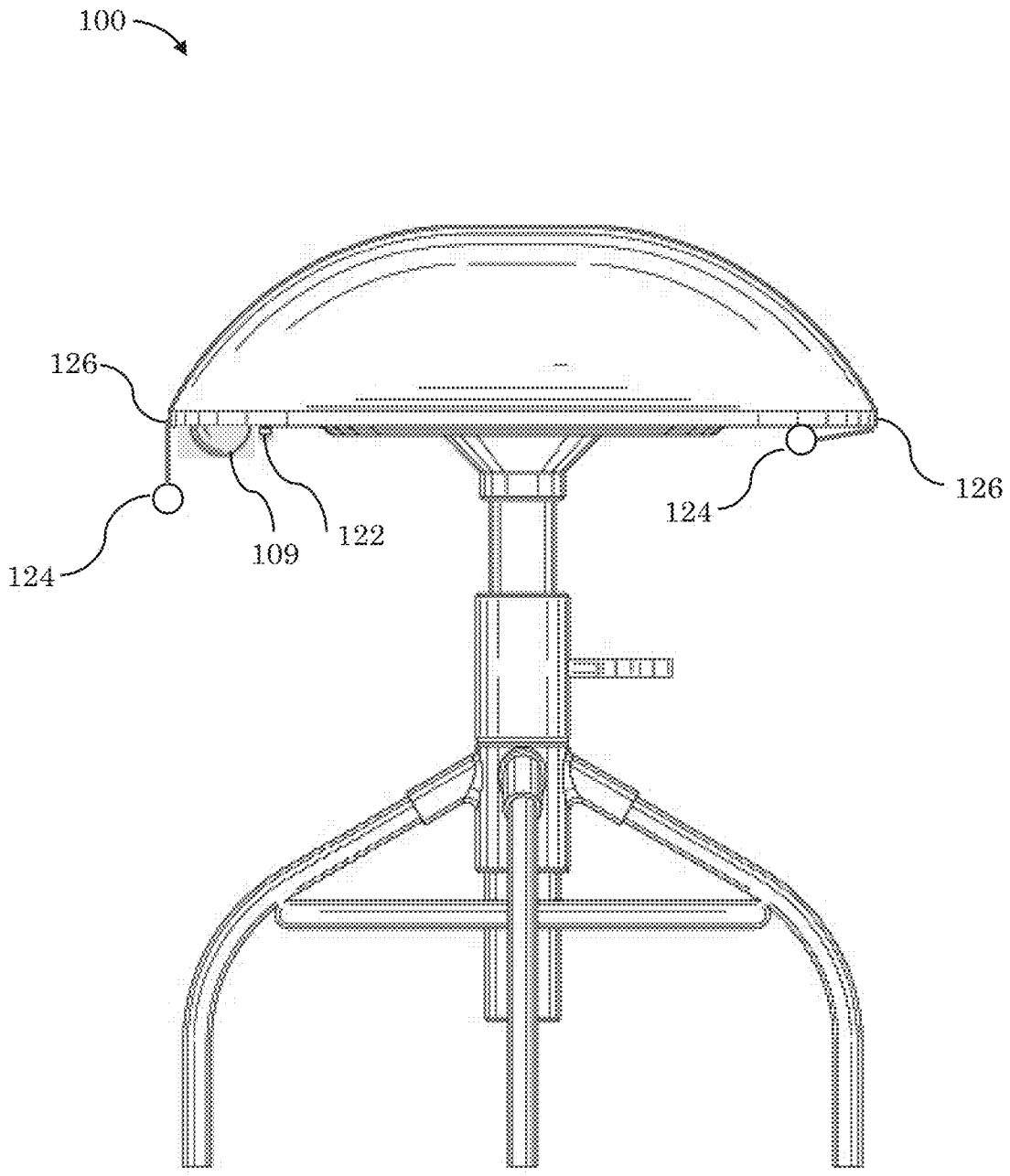
FIG. 6 illustrates an elevation view of a forth side of the posture correcting chair according to an embodiment of the invention.

As shown in FIG. 6, handles 124 may also be pivoted, through the use of hinges 126, such that they are positioned below the seating component 102. In particular, a user may position the handles below the seating component 102 perpendicular or substantially parallel to the base element 102. The different positioning of the handles 124 provides a number of benefits to a user. For example, aside from balancing during sitting, a user may utilize the handles 124 to transport the posture correcting chair 100 easily. In another example, the user may attach certain items—such as cords or writing utensils—to handles 124.

Figure 7:
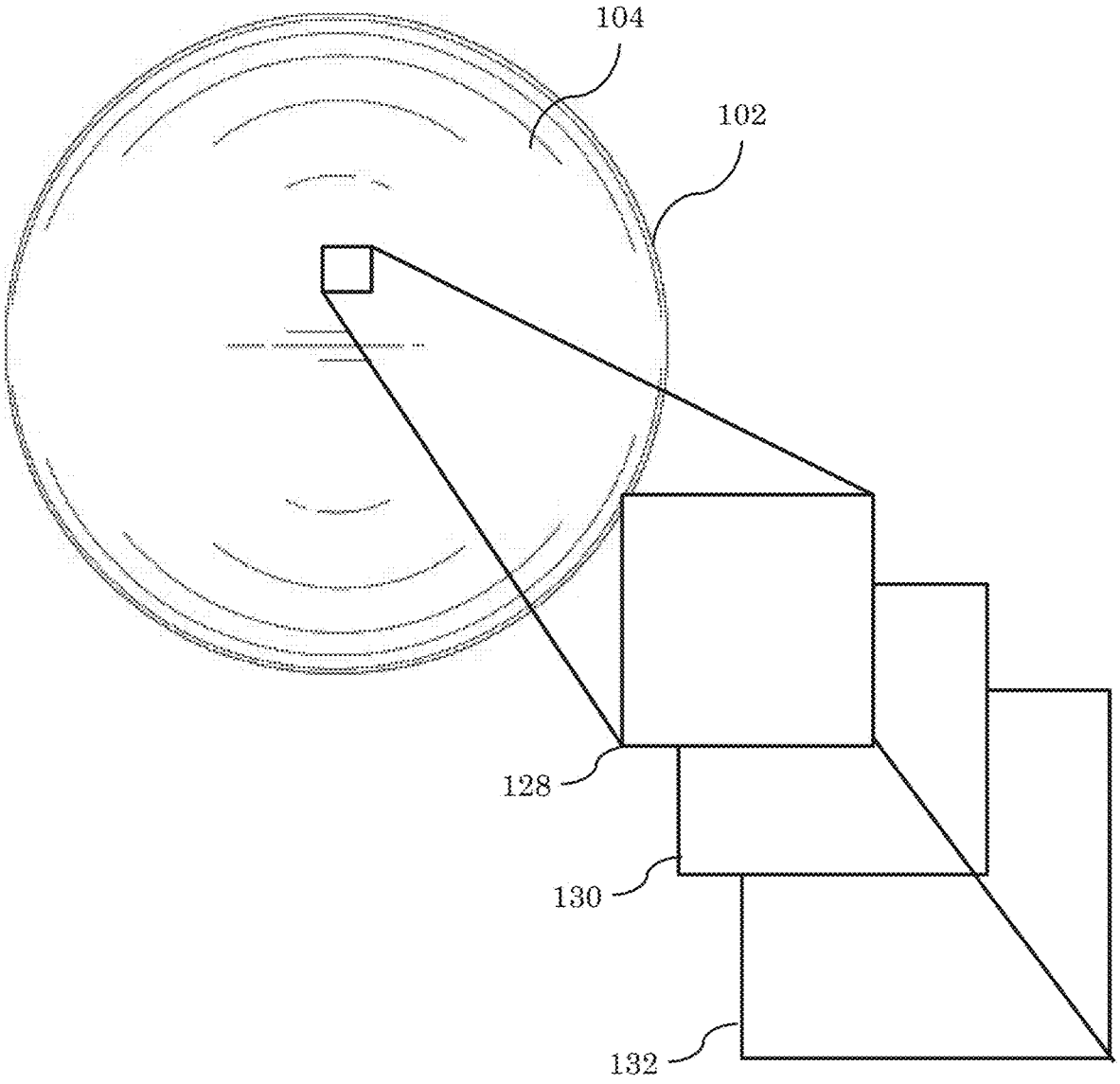
FIG. 7 illustrates a top view of a seating component of the posture correcting chair according to an embodiment of the invention.

FIG. 7 illustrates a top view of the seating component 102 of the posture correcting chair 100. As shown in FIG. 7, the inflatable element 104 of the seating component 102 may include three layers: an upholstery layer 128, a silicone polymer layer 130, and an elastomer layer 132. The upholstery layer 128 may cover the seating component 102 and include a fabric, such as cotton, polyester, or a combination of each. The housing 108—formed by the inflatable element 104 and the base element 106—may include the silicone polymer layer 130 and elastomer layer 132. In particular, the silicone polymer layer 130 may act as barrier to protect the elastomer layer 132 from cuts or punctures to the seating component 102.

Alterations to the posture correcting chair may include the addition of one or more sensors, such as a pressure sensor or proximity sensor. A pressure sensor may detect the pressure within the housing to determine whether a user is sitting on the seating component. Moreover, the pressure sensor may determine the amount of medium within the housing. A proximity sensor may emit an electromagnetic field and detect changes in the field to determine whether a user is nearby. Advantageously, in response to the determination of the one or more sensors, the posture correcting chair 100 may automatically activate a pump mechanism to inflate or deflate a housing. In certain embodiments, the posture correcting chair, in response to detecting the pressure, may be configured to provide a signal, such as a visual or sound. In other embodiments, the posture correcting chair may communicate with a user device through one or more standardized communication methods to transmit certain information, such as the pressure within the housing or the amount of time a user has been sitting.

While this disclosure is susceptible to various modifications and alternative forms, specific exemplary embodiments thereof have been shown by way of example in the drawings and have herein been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

What is claimed is:

1. A posture correcting chair, comprising:

a seating component including an inflatable element and a base element, the inflatable element and base element forming a housing such that the seating component is in a semi-spherical configuration when inflated and a compressed configuration when deflated, said semi-spherical configuration shaped to correct a posture of an occupant, said seating component including an upholstery layer covering the housing, said housing comprising an elastomer layer;

a pump mechanism extending from said seating component, the pump mechanism facilitating inflating and deflating said housing; and a frame assembly connected to said seating component, the frame assembly comprising a post member, a height adjusting cylinder, and a plurality of supports.

2. The posture correcting chair of claim 1, further comprising:

a foot bar positioned on said post member, wherein said foot bar is adjustable in height.

3. The posture correcting chair of claim 1, further comprising:

a lever connected to said height adjusting cylinder, wherein said lever is configured to adjust a height of said seating component.

4. The posture correcting chair of claim 1, further comprising:

a pair of handle bars positioned on opposing sides of said seating component.

5. The posture correcting chair of claim 4, wherein the posture correcting chair does not have an arm rest.

6. The posture correcting chair of claim 4, wherein the posture correcting chair does not have a back rest.

7. The posture correcting chair of claim 1, further comprising:

a first hole and a second hole interposed between the inflatable element and the base element of said seating component, wherein said pump mechanism is configured to open and close at least one of the first hole and the second hole;

a first pathway configured to convey a medium from outside the housing through the first hole to inside the housing; and a second pathway configured to convey the medium from inside the housing through the second hole to outside the housing.

8. The posture correcting chair of claim 7, wherein said pump mechanism comprises a manually-operated pump for pumping said medium into the housing and removing said medium out from the housing.

9. The posture correcting chair of claim 7, wherein said pump mechanism comprises an electric pump that is configured to pump said medium into the housing and extract said medium out from the housing.

10. The posture correcting chair of claim 7, wherein said medium is at least one of a gas or a liquid.

11. The posture correcting chair of claim 1, further comprising a release tab to assist in deflating said housing.

12. The posture correcting chair of claim 1, further comprising a silicone polymer interposed between the upholstery layer and the elastomer layer.

13. The posture correcting chair of claim 1, further comprising a pressure sensor configured to detect a pressure in the housing.

14. The posture correcting chair of claim 13, wherein said pump mechanism is configured to automatically inflate said seating component in response to the pressure detected.

15. The posture correcting chair of claim 13, wherein said pump mechanism is configured to automatically deflate said seating component in response to the pressure detected.

16. The posture correcting chair of claim 1, further comprising a proximity sensor configured to detect the occupant, wherein said pump mechanism is configured to automatically inflate said seating component in response to detecting the occupant.

17. The posture correcting chair of claim 1, further comprising a proximity sensor, wherein said pump mechanism is configured to automatically deflate said seating component when the proximity sensor indicates absence of the occupant.

* * * * *